US009815284B2

(12) United States Patent
Takeuchi

(10) Patent No.: US 9,815,284 B2
(45) Date of Patent: Nov. 14, 2017

(54) LIQUID DISCHARGE HEAD, LIQUID DISCHARGE DEVICE, AND LIQUID DISCHARGE APPARATUS

(71) Applicant: Noriyasu Takeuchi, Kanagawa (JP)

(72) Inventor: Noriyasu Takeuchi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/090,965

(22) Filed: Apr. 5, 2016

(65) Prior Publication Data

US 2016/0297195 A1 Oct. 13, 2016

(30) Foreign Application Priority Data

Apr. 7, 2015 (JP) ..... 2015-078512
Jan. 28, 2016 (JP) ..... 2016-014397

(51) Int. Cl.
*B41J 2/175* (2006.01)
*B41J 2/14* (2006.01)

(52) U.S. Cl.
CPC .. *B41J 2/14274* (2013.01); *B41J 2002/14419* (2013.01); *B41J 2202/12* (2013.01)

(58) Field of Classification Search
USPC ..... 347/65
See application file for complete search history.

(56) References Cited

U.S. PATENT DOCUMENTS 5,489,930 A * 2/1996 Anderson ..... B41J 2/17563 210/488
5,610,645 A * 3/1997 Moore ..... B41J 2/161 210/498
6,086,195 A * 7/2000 Bohorquez ..... B41J 2/17563 347/93
6,643,220 B2 * 11/2003 Anderson ..... B41J 2/17 347/18
6,685,299 B2 * 2/2004 Hirota ..... B41J 2/14209 347/20
7,121,643 B2 * 10/2006 Yamada ..... B41J 2/14209 347/20

(Continued)

FOREIGN PATENT DOCUMENTS

| | | |
|---|---|---|
| JP | 2006-126496 | 5/2006 |
| JP | 2011-026663 | 2/2011 |
| JP | 2014-141102 | 8/2014 |

*Primary Examiner* — Matthew Luu
*Assistant Examiner* — Lily Kemathe
(74) *Attorney, Agent, or Firm* — Cooper & Dunham LLP

(57) ABSTRACT

A liquid discharge head includes nozzles, pressure chambers, pressure generators, a common liquid chamber, a partition, and a liquid feeder. The common liquid chamber includes two chamber portions adjacent to each other on a plane parallel to a nozzle array direction. The two chamber portions include a first chamber portion to receive liquid from a supply unit and a second chamber portion to supply liquid to the pressure chambers. The partition includes openings and partitions the first portion from the second portion. The first portion includes at least one liquid inlet at a first end and at least one liquid outlet at a second end opposite the first end in the nozzle array direction. The second portion has a cross-sectional area smaller than a cross-sectional area of the first portion in a cross section of the two chamber portions perpendicular to the nozzle array direction.

13 Claims, 8 Drawing Sheets

(56) References Cited

U.S. PATENT DOCUMENTS 7,244,020 B2 * 7/2007 Chikamoto ..... B41J 2/14209 347/93
7,775,652 B2 * 8/2010 Taira ..... B41J 2/1607 347/71
7,901,064 B2 * 3/2011 Urayama ..... B41J 2/14145 347/65
8,016,396 B2 * 9/2011 Kobayashi ..... B41J 2/17559 347/85
8,057,026 B2 * 11/2011 Kimura ..... B41J 2/16523 347/86
8,123,339 B2 * 2/2012 Mori ..... B41J 2/14274 347/71
8,172,389 B2 * 5/2012 Sugahara ..... B41J 2/14233 347/5
8,348,407 B2 * 1/2013 Matsufuji ..... B41J 2/14233 347/93
8,371,686 B2 * 2/2013 Yokouchi ..... B41J 2/17509 347/92
8,714,722 B2 * 5/2014 Hays ..... B41J 2/17563 210/799
9,033,482 B2 * 5/2015 Agarwal ..... B41J 2/14016 347/65
9,044,946 B2 * 6/2015 Kohda ..... B41J 2/145
9,050,803 B2 * 6/2015 Koda ..... B41J 2/1433
9,067,427 B2 * 6/2015 Hayashi ..... B41J 2/17563
9,120,320 B2 * 9/2015 Yoneta ..... B41J 2/17563
9,266,345 B2 * 2/2016 Kimura ..... B41J 2/20
2002/0171715 A1 * 11/2002 Takahagi ..... B41J 2/14274 347/70
2003/0156158 A1 * 8/2003 Hirota ..... B41J 2/055 347/54
2005/0117005 A1 * 6/2005 Fujii ..... B41J 2/1603 347/92
2006/0007272 A1 * 1/2006 Ogata ..... B41J 2/055 347/70
2007/0176990 A1 * 8/2007 Urayama ..... B41J 2/14145 347/93
2007/0229588 A1 * 10/2007 Furukawa ..... B41J 2/16535 347/33
2007/0289942 A1 * 12/2007 Fujii ..... B41J 2/1603 216/27
2008/0303884 A1 * 12/2008 Miura ..... B41J 2/14274 347/93
2010/0282342 A1 * 11/2010 Aoyama ..... B41J 2/17563 137/544
2010/0328409 A1 * 12/2010 Matsufuji ..... B41J 2/14233 347/93
2011/0261124 A1 * 10/2011 Baumer ..... B41J 2/09 347/93
2013/0147887 A1 * 6/2013 Kimura ..... B41J 2/20 347/93
2013/0242012 A1 * 9/2013 Hayashi ..... B41J 2/17563 347/93
2013/0307911 A1 * 11/2013 Hayashi ..... B41J 2/17563 347/93
2014/0009544 A1 * 1/2014 Koda ..... B41J 2/1433 347/94
2015/0077469 A1 3/2015 Kohda et al.

* cited by examiner

LIQUID DISCHARGE HEAD, LIQUID DISCHARGE DEVICE, AND LIQUID DISCHARGE APPARATUS

CROSS-REFERENCE TO RELATED APPLICATIONS

This patent application is based on and claims priority pursuant to 35 U.S.C. §119(a) to Japanese Patent Application Nos. 2015-078512, filed on Apr. 7, 2015, and 2016-014397, filed on Jan. 28, 2016, in the Japan Patent Office, the entire disclosure of each of which is hereby incorporated by reference herein.

BACKGROUND

Technical Field

Aspects of the present disclosure relate to a liquid discharge head, a liquid discharge device, and a liquid discharge apparatus.

Related Art

For a liquid discharge head, the viscosity of liquid to be discharged changes with temperature. Therefore, by constantly detecting the temperature of discharge liquid, pressure generators are properly controlled according to the viscosity of liquid to maintain a constant image quality regardless of the environment. In such a liquid discharge head, if liquid is continuously discharged from some nozzle orifices, heat generated by the pressure generators causes a temperature difference in discharge liquid. Hence, for example, multiple temperature detectors are disposed to more finely detect the temperature of discharge liquid so that more proper discharge control is performed according to the temperature of discharge liquid.

However, to more finely detect the temperature of discharge liquid, the number of temperature detectors increases and the discharge control becomes complicated, thus increasing the head size and cost. Preferably, discharge control is performed with a smaller number of temperature detectors and the temperature difference of discharge liquid in the head is smaller.

SUMMARY

In an aspect of this disclosure, there is provided a liquid discharge head that includes a plurality of nozzles, a plurality of pressure chambers, a plurality of pressure generators, a common liquid chamber, a partition, and a liquid feeder. The plurality of nozzles discharges liquid. The plurality of pressure chambers is communicated with the plurality of nozzles. The plurality of pressure generators generate pressure in the plurality of pressure chambers. The common liquid chamber supplies liquid to the plurality of pressure chambers. The common liquid chamber includes two liquid chamber portions adjacent to each other on a plane parallel to a nozzle array direction in which the plurality of nozzles is arrayed. The two liquid chamber portions include a first common liquid chamber portion to receive liquid from a liquid supply unit and a second common liquid chamber portion to supply liquid to the plurality of pressure chambers. The partition includes openings and partitions the first common liquid chamber portion from the second common liquid chamber portion. The first common liquid chamber portion includes at least one liquid inlet at a first end and at least one liquid outlet at a second end opposite the first end in the nozzle array direction. The liquid feeder supplies liquid to the at least one liquid inlet and to drain liquid from the at least one liquid outlet. The second common liquid chamber portion has a cross-sectional area smaller than a cross-sectional area of the first common liquid chamber portion in a cross section of the two common liquid chamber portions perpendicular to the nozzle array direction.

In another aspect of this disclosure, there is provided a liquid discharge device that includes the liquid discharge head.

In still another aspect of this disclosure, there is provided a liquid discharge apparatus that includes the liquid discharge device.

In still yet another aspect of this disclosure, there is provided a liquid discharge apparatus that includes the liquid discharge head.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

DETAILED DESCRIPTION

Figure 1:
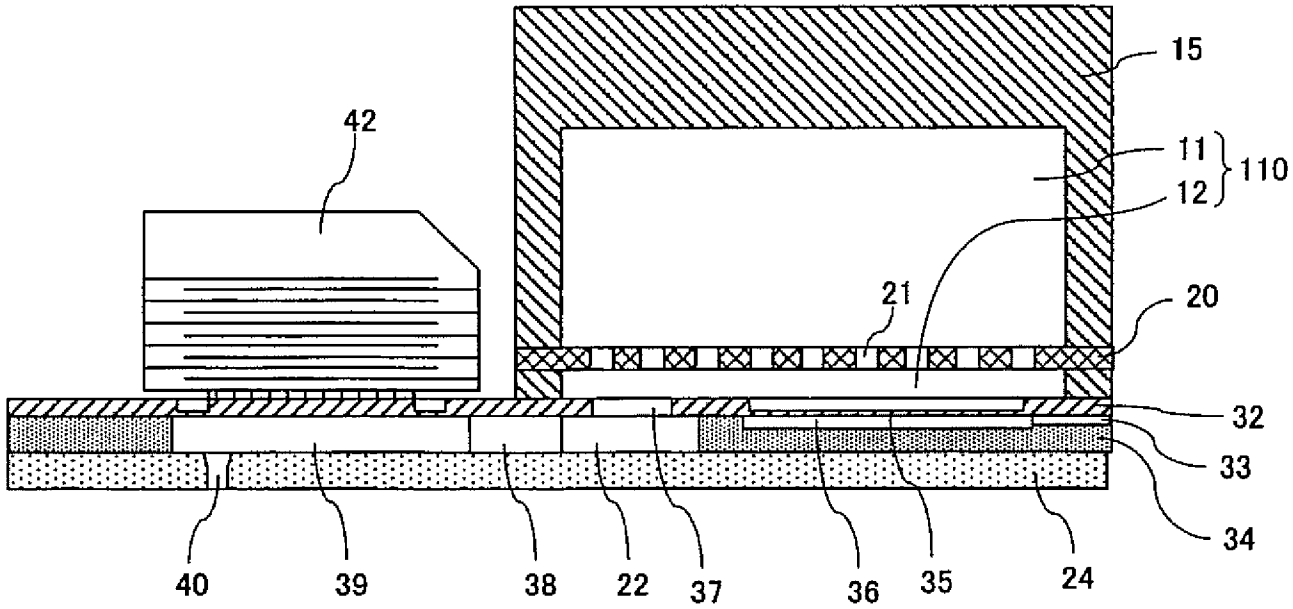
FIG. 1 is an illustration of a liquid discharge head according an embodiment of this disclosure.

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Below, a liquid discharge head, a liquid discharge device, and a liquid discharge apparatus according to embodiments of the present disclosure are described with reference to the drawings attached. Note that the present invention are not limited to the following embodiments and may be other embodiments. The following embodiments may be modified by, e.g., addition, modification, or omission within the scope that would be obvious to one skilled in the art. Any aspects having advantages as described for the following embodiments according to the present invention are included within the scope of the present invention.

A liquid discharge head 404 according to an embodiment of the present disclosure includes a plurality of nozzles 40 to discharge liquid, a plurality of pressure chambers 39 communicated with the nozzles 40, a plurality of piezoelectric elements 42 as pressure generators to generate pressure in the respective pressure chambers 39, and a common liquid chamber 110 to supply liquid to the pressure chambers 39. The common liquid chamber 110 includes two liquid chamber portions adjacent to each other in a plane parallel to a nozzle array direction in which the nozzles 40 are arrayed in line. The two liquid chambers are a first common liquid chamber portion 11 and a second common liquid chamber portion 12. The first common liquid chamber portion 11 receives liquid from a liquid supply portion. The second common liquid chamber portion 12 supplies liquid to the pressure chambers 39. The first common liquid chamber portion 11 and the second common liquid chamber portion 12 are partitioned by a partition 20 having openings 21. The first common liquid chamber portion 11 has at least one liquid inlet 14 and at least one liquid outlet 16 in the nozzle array direction. Each end of the first common liquid chamber portion 11 has the liquid inlet 14 or the liquid outlet 16. A liquid feeder is provided to supply liquid to the liquid inlet 14 and output liquid from the liquid outlet 16. In a cross section of the two liquid chambers perpendicular to the nozzle array direction, the second common liquid chamber portion 12 has a cross-sectional area smaller than a cross-sectional area of the first common liquid chamber portion 11. The liquid discharge head 95 is further described below.

Liquid discharge head A liquid discharge head according to an embodiment of this disclosure is described with reference to FIG. 1. Note that the term "head" used herein has the same meaning of the term "liquid discharge head". The term "discharge liquid" and the term "liquid have the same meaning.

FIG. 1 is a cross-sectional view of a configuration of a liquid discharge head 404 according to an embodiment of the present disclosure. FIG. 1 is also a cross-sectional view of one nozzle. In FIG. 1 are illustrated, e.g., the first common liquid chamber portion 11, the second common liquid chamber portion 12, a liquid supply channel 13, a support 15, a partition 20, a diaphragm 32, a nozzle substrate 24, a communication substrate 33, a channel substrate 34, a damper 35, a damper chamber 36, a supply port 37, a fluid resistance portion 38, the pressure chamber (individual liquid chamber) 39, the nozzle 40, the piezoelectric element (laminated piezoelectric element) 42.

By the partition 20 having openings, the common liquid chamber 110 is partitioned into the first common liquid chamber portion 11 at circulation side and the second common liquid chamber portion 12 at discharge side. As described below, in this embodiment, in a cross section perpendicular to the nozzle array direction, the cross-sectional area of the first common liquid chamber portion 11 is greater than the cross-sectional area of the second common liquid chamber portion 12.

The second common liquid chamber portion 12 at discharge side includes an individual channel 22 to supply liquid to each nozzle 40. The individual channel 22 is communicated with the pressure chamber 39 provided with a pressure generator, via the fluid resistance portion 38. The piezoelectric element (laminated piezoelectric element) 42 as the pressure generator changes the volume of the pressure chamber 39 via the diaphragm 32 to discharge liquid from the nozzle 40. Note that, in this embodiment, the laminated piezoelectric element is used as the pressure generator. However, the pressure generator is not limited to the laminated piezoelectric element and may be any other suitable piezoelectric element.

Figure 2:
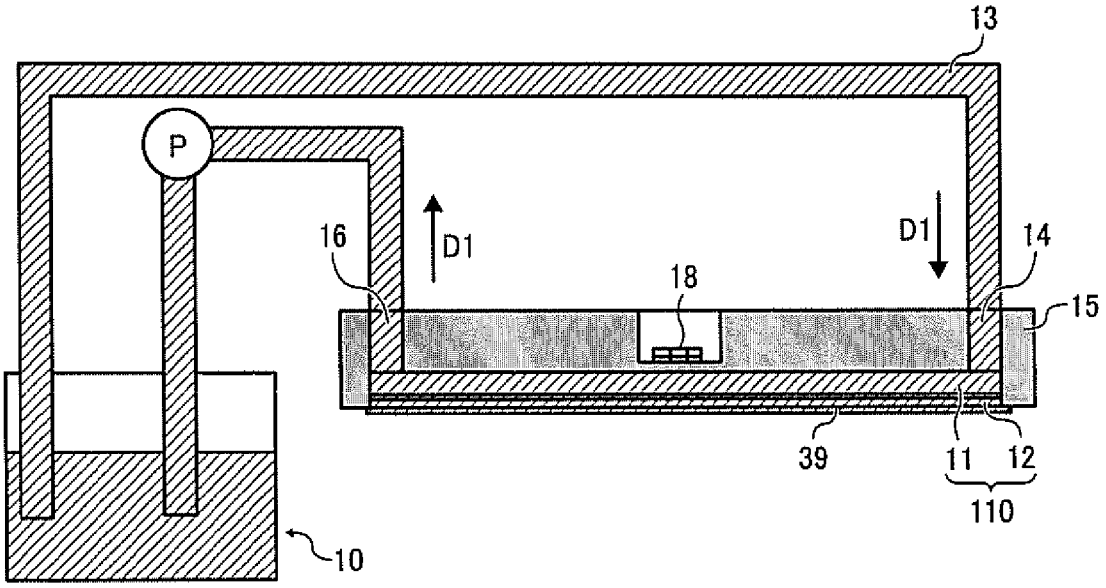
FIG. 2 is another illustration of the liquid discharge head of FIG. 1.

FIG. 2 is another cross-sectional view of the liquid discharge head 404 according to this embodiment. In FIG. 2 are illustrated, e.g., the first common liquid chamber portion 11, the second common liquid chamber portion 12, the liquid inlet 14, the liquid outlet 16, a temperature detector 18, a liquid reservoir (ink tank) 10.

In this embodiment, the plurality of nozzles 40 are arrayed in the liquid discharge head 404, and the common liquid chamber 110 is disposed to supply discharge liquid in the nozzle array direction. The common liquid chamber 110 is divided into the first common liquid chamber portion 11 and the second common liquid chamber portion 12 by the partition 20. The liquid inlet 14 as a liquid supply port to supply liquid and the liquid outlet 16 as a liquid output port to output liquid are disposed on both ends of the first common liquid chamber portion 11. A pump P as the liquid feeder is provided to circulate liquid even during liquid discharge. As indicated by arrow D1 in FIG. 2, discharge liquid is circulated through the liquid supply channel 13, the liquid inlet 14, the liquid outlet 16, and the liquid reservoir 10 by the pump P.

In this embodiment, as described above, the common liquid chamber 110 is divided into two liquid chamber portions and discharge liquid is circulated in the first common liquid chamber portion 11 at circulation side. Such a configuration suppresses a rise in temperature of the head due to heat generation in the head and reduce the difference in temperature of discharge liquid in the head. Accordingly, even when the voltage applied to the piezoelectric element 42 is adjusted in accordance with the temperature detected by the single temperature detector 18, the liquid discharge head 404 reduces variations in speed of discharge liquid due to the difference between the detected temperature and the temperature of discharge liquid. In the second common liquid chamber portion 12, only a liquid flow due to discharge of liquid arises and no liquid flow due to circulation arises. Accordingly, the above-described configuration reduces the influence of liquid circulation to liquid discharge.

Typically, by discharging liquid in a temperature rise of the head, heat is exhausted. If discharge liquid at the discharge side from the partition 20 remains undischarged, heat would not be exhausted and the temperature of the head would rise. Hence, to prevent drying of discharge liquid at the surface of a nozzle orifice, generally, vibration is applied to liquid in the liquid chamber to an extent that liquid is not discharged from the nozzle. In such a case, since heat is not exhausted by liquid discharge, vibration causes a rise in temperature of liquid although the amount of heat generated is slight.

Accordingly, a portion of the head from which liquid is not discharged has a higher temperature than a portion of the head from which liquid is discharged and heat is exhausted. As the volume of the discharge side (the volume of the second common liquid chamber portion 12) is greater, the amount of liquid have risen in temperature is greater. As a result, the time from when new liquid is supplied from the circulation side to when the liquid is discharged from the head is longer, and the temperature difference of discharge liquid in the nozzle array direction is likely to occur and affect the liquid discharge.

By contrast, in this embodiment, the first common liquid chamber portion 11 has a cross-sectional area greater than a cross-sectional area of the second common liquid chamber portion 12. In a movement route of liquid to be discharged from the nozzle 40, the movement of liquid in the nozzle array direction is constantly performed at the circulation side (the first common liquid chamber portion 11). Since reducing the volume of the discharge side (the second common liquid chamber portion 12) allows a reduction in the amount of discharge liquid at the discharge side, the above-described temperature difference can be reduced. Since the ratio of discharge liquid remaining in the head to circulated discharge liquid is small, the temperature is unlikely to change. Accordingly, the amount of discharge liquid causing a temperature difference can be reduced, thus reducing the influence to the liquid discharge (easily returning to uniform temperature distribution by the start of liquid discharge.

In this embodiment, the temperature change of the head (heat generation by the pressure generator) is also reduced by circulation of liquid. In addition, discharging circulated discharge liquid reduces variation in temperature of discharge liquid in the head.

Thus, since the temperature variation in the head can be reduced, the difference between the actual temperature of discharge liquid and the detected temperature of discharge liquid with a small number of temperature detectors is reduced, thus reducing variation in speed of discharge liquid. Such a configuration allows optimal print control.

In FIG. 2, an example is illustrated in which the pump P is disposed at the outlet side and discharge liquid is circulated in the first common liquid chamber portion 11. However, the liquid feeder for circulation is not limited to the configuration of the example. In FIG. 2, a configuration example is also illustrated in which the liquid inlet 14 and the liquid outlet 16 are disposed at the respective ends of the first common liquid chamber portion 11. However, the configuration of the first common liquid chamber portion 11 is not limited to the configuration example and may be any other suitable configuration. For example, the liquid inlet 14 may be disposed at a center portion of the first common liquid chamber portion 11 and the liquid outlet 16 may be disposed at each end of the liquid outlet 16.

Figure 3:
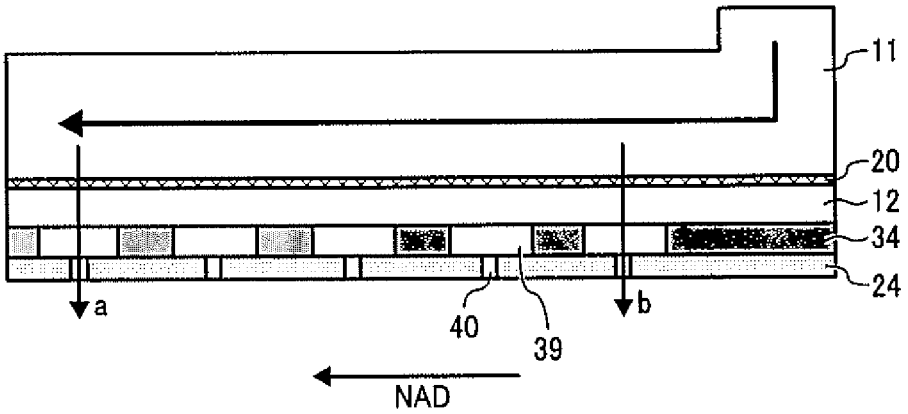
FIG. 3 is an illustration of the liquid discharge head of FIG. 1 with a flow of ink.

FIG. 3 is an enlarged view of an area around a discharge portion of the head 404 of FIG. 1. As described above, the common liquid chamber 110 continuous in the nozzle array direction is partitioned into two chamber portions by the partition 20. In the first common liquid chamber portion 11, liquid is circulated from the liquid inlet 14 toward the liquid outlet 16 by the pump at the liquid supply channel 13. In the first common liquid chamber portion 11, liquid is circulated in the nozzle array direction indicated by arrow NAD in FIG. 3. Thus, liquid is supplied to the second common liquid chamber portion 12 parallel to the first common liquid chamber portion 11 by an amount consumed by liquid discharge. At this time, the first common liquid chamber portion 11 has a cross-sectional area greater than a cross-sectional area of the second common liquid chamber portion 12.

By constantly circulating an amount of discharge liquid not less than an amount discharged from the head 404, the temperature rise in the head is reduced while preventing a temperature rise due to discharge liquid remaining in the head.

When discharge liquid is discharged from a nozzle 40 of the head 404, the discharge liquid moves in the nozzle array direction in the first common liquid chamber portion 11 having a lower fluid resistance. The discharge liquid is further supplied from openings 21, in which liquid is movable in the partition 20, to the second common liquid chamber portion 12 above the nozzle 40, and discharged from the nozzle 40. Accordingly, the movement time of discharge liquid in the route from the liquid inlet 14 to the liquid discharge is shortened, thus reducing a temperature rise of ink in the head 404.

As described above, this embodiment can obtain the advantage of reducing a temperature rise in the head by circulating discharge liquid and the advantage of reducing a temperature rise of discharge liquid in the head by shortening the elapsed time from the liquid inlet 14 to the liquid discharge in the head. Such advantageous effects reduces the occurrence of a temperature difference in discharge liquid due to execution/non-execution of liquid discharge or distance from the liquid reservoir 10. Accordingly, even when a large number of temperature detectors are not disposed in the nozzle array direction, the difference in the detected temperature and the actual temperature of discharge liquid is reduced, thus allowing stable liquid discharge.

Figure 4:
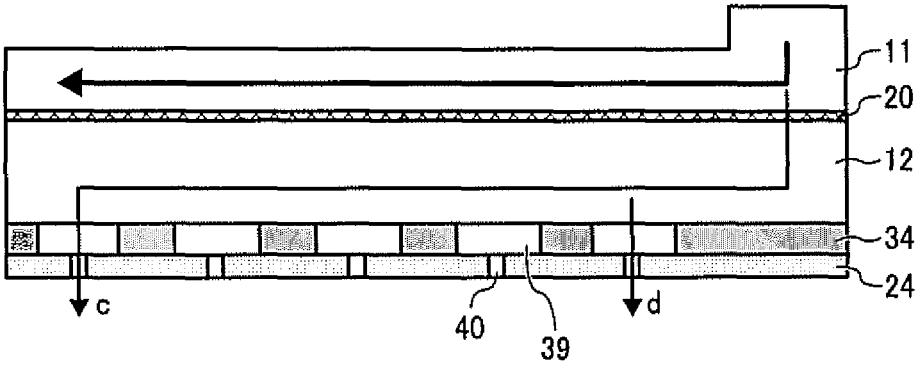
FIG. 4 is an illustration of a liquid discharge head according to a comparative example, with a flow of ink.

FIG. 4 is an enlarged view of an area around a discharge portion of a head according to a comparative example. FIG. 4 is an illustration of the comparative example in which a cross-sectional area of a second common liquid chamber portion 12 in a cross section perpendicular to a nozzle array direction is not less than a cross-sectional area of a first common liquid chamber portion 11. In such a case, in moving to a nozzle row from which to be discharged, discharge liquid passes a discharge-side common liquid chamber portion (the second common liquid chamber portion 12) having relatively low resistance. Since the movement of liquid in the second common liquid chamber portion 12 is caused by only the consumption of liquid discharged from the nozzle row, the time of movement of discharge liquid from a liquid inlet 14 of the first common liquid chamber portion 11 to the discharge of liquid from the nozzles is long.

The rise in the temperature of discharge liquid circulating in the first common liquid chamber portion 11 is prevented. By contrast, in the second common liquid chamber portion 12 in which discharge liquid is not circulated, the temperature of discharge liquid is raised by heat generated by a pressure generator. Accordingly, the temperature of liquid discharged rises, and for example, a temperature difference is likely to occur between nozzles 40 close to and far from the liquid inlet 14.

Figure 5:
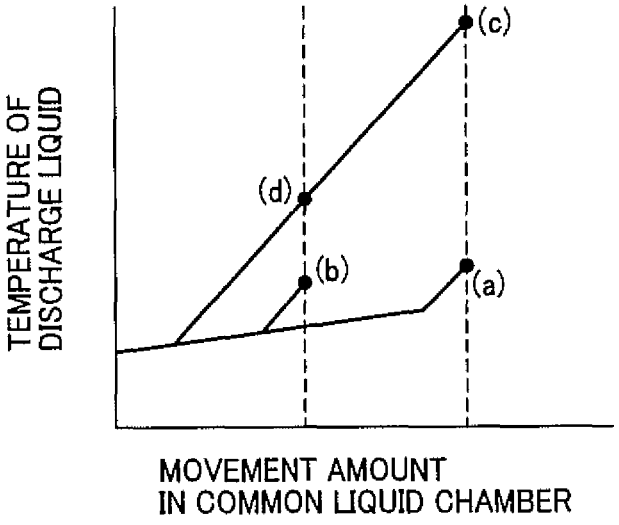
FIG. 5 is a graph of a temperature difference between different positions of nozzles of a liquid discharge head according to an embodiment of this disclosure.

FIG. 5 is a graph of temperature differences between different positions of nozzles and is an illustration of relationships between the temperature of discharge liquid and the movement amount of discharge liquid in the common liquid chamber 110 at positions a, b, c, and d in FIGS. 3 and 4. Since discharge liquid moves faster at the circulation side, the rate of the temperature rise to the movement amount is smaller. By contrast, at the discharge side, discharge liquid is caused by only the discharge of liquid, and thus the rate of the temperature rise to the movement amount is greater. Accordingly, in FIG. 3, the temperature difference is not so large between different nozzle positions (a and b in FIG. 5). By contrast, the temperature difference is relatively large between different nozzle positions (c and d in FIG. 5). Additionally, increasing the cross-sectional area of the circulation side (the first common liquid chamber portion 11) reduces the fluid resistance against circulating discharge liquid, thus reducing the occurrence of a pressure difference due to circulation.

Next, the partition 20 is further described below. For example, a liquid chamber may be divided by a filter. By contrast, in this embodiment, the partition 20 can obviate the function of such a filter. In other words, the common liquid chamber 110 is divided, and in the divided state, discharge liquid is movable through the openings 21. In addition, for the filter, for example, there may occur a constraint that the diameter of opening be smaller than the diameter of nozzle. However, there is no such a constraint for the openings 21 of the partition 20 in this embodiment, as long as discharge liquid is movable.

The openings of the partition may be changed in other embodiments. However, preferably, the representative length of the opening of the partition is greater than the nozzle diameter. When the representative length of the opening of the partition is greater than the nozzle diameter, the filter function can be obviated from the partition. One advantage obtained by obviating the filter function from the partition 20 is to prevent uneven supply of discharge liquid due to clogging. When the partition having the filter function clogs, discharge liquid is not supplied at a clogged portion. As a result, liquid is forced to move in the second common liquid chamber portion 12, thus causing a temperature difference. According to the partition 20 of this embodiment, the representative length of opening of the partition 20 is greater than the nozzle diameter, thus preventing such a failure. Here, the representative length of an opening means a diameter of the opening when the opening is circular. When the opening is oval, the representative length means a short diameter of the oval opening. When the opening is a slit, the representative length means a slit width of the opening.

As described above, preferably, the representative length of the opening of the partition is greater than the nozzle diameter. However, the configuration of the opening is not limited to the above-described configuration. In some embodiments, the representative length of the opening may be smaller than the nozzle diameter. In such a case, the partition may have a filter function, thus allowing another filter member, if any, to be obviated. Additionally, circulation of discharge liquid have an advantage of preventing clogging of the filter. Alternatively, in some embodiments, another filter member is provided separately from the partition. In such a case, the partition preferably has no filter function. Further, in some embodiment, the partition may include both openings having a representative length greater than the nozzle diameter and openings having a representative length smaller than the nozzle diameter.

The partition 20 is preferably made of a metal having a higher thermal conductivity than a thermal conductivity of discharge liquid to contribute to a reduction in temperature difference of liquid between the two common liquid chamber portions. For example, stainless steel (SUS) material (16.7 W/mK) is preferably usable for aqueous discharge liquid (a thermal conductivity of water of 0.582 W/mk). Aluminum or copper is a better thermal conductor. However, SUS material is preferably used because aluminum or copper is disadvantageous in liquid contact property, such as corrosion, relative to aqueous discharge liquid.

Figure 6:
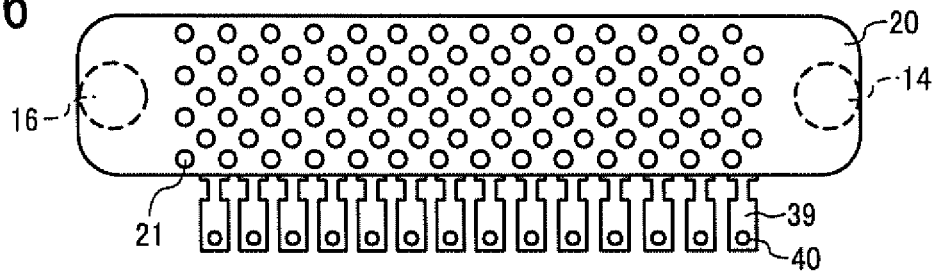
FIG. 6 is an illustration of an example of a partition according to an embodiment of this disclosure.

FIG. 6 is a plan view of an example of the partition. In FIG. 6 is illustrated an example of the arrangement of the openings 21 in the partition 20. Note that, in FIG. 6, the liquid inlet 14 and the liquid outlet 16 are indicated by broken lines but are not formed in the partition 20. The broken lines schematically represent the arrangement of the liquid inlet 14 and the liquid outlet 16 in a plan view seen from an upper face of the head.

In this embodiment, the openings 21 of the partition 20 are evenly disposed relative to an array of nozzles. Accordingly, as a route to supply discharge liquid to nozzles, discharge liquid is transferred from the circulation side to the discharge side through immediate openings 21, thus preventing the occurrence of difference between nozzle positions.

Figure 7:
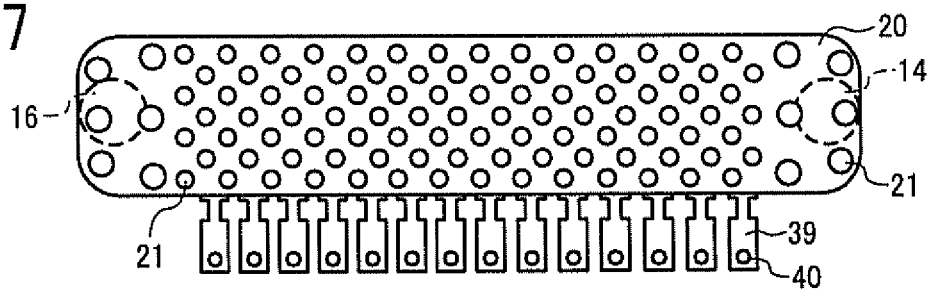
FIG. 7 is an illustration of another example of the partition.

FIG. 7 is a plan view of another example of the partition. Locating the openings 21 only within a range of the nozzle array as illustrated in FIG. 6 does not matter in liquid supply. However, when bubbles enter a supply liquid chamber, bubbles may remain in the chamber without being exhausted. Such entry of bubbles may cause discharge failure.

Hence, in FIG. 7, the openings 21 of the partition 20 are disposed in an entire range of the common liquid chamber 110. In other words, the partition 20 has the openings 21 across the entire range in the nozzle array direction. As illustrated in FIG. 7, unlike the configuration of FIG. 6, the openings 21 are disposed around the liquid inlet 14 and the liquid outlet 16. When bubbles enter or are generated at the discharge side, such a configuration allows bubbles to be exhausted without remaining in the common liquid chamber 110. In other words, bubbles are exhausted to the circulation side through the openings 21 and further exhausted from the common liquid chamber 110 by circulation of liquid. Such a configuration prevents the occurrence of discharge failure due to entry of bubbles.

Figure 8:
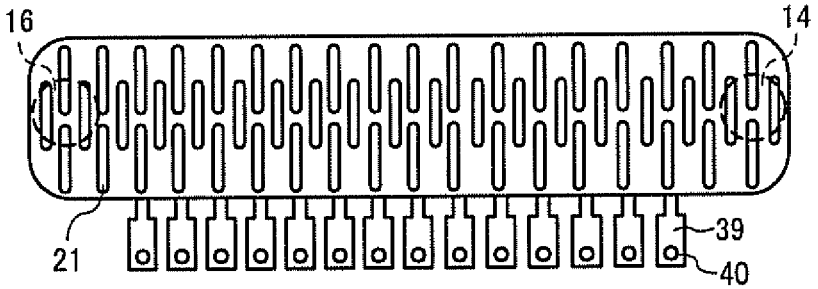
FIG. 8 is an illustration of still another example of the partition.

FIG. 8 is a plan view of still another example of the partition. In the above-described embodiments of FIGS. 6 and 7, the openings 21 are circular. However, the shape of the opening 21 is not limited to the circular shape and may be, for example, a slit shape illustrated in FIG. 8.

In addition, dampers 35, which are variable in volume in response to pressure fluctuations of the head, are disposed in the head so that the pressure fluctuations caused by liquid discharge do not affect the discharge of liquid from other nozzles. In FIG. 1, a damper portion (a damper 35 and a damper chamber 36) is disposed in the second common liquid chamber portion 12, which is a discharge-side common liquid chamber. As illustrated in FIG. 1, the second common liquid chamber portion 12 includes the damper portion on a first face opposite a second face facing the partition 20. Here, when the damper portion is disposed at the first common liquid chamber portion 11 which is a circulation-side common liquid chamber, the partition 20 is disposed between the first common liquid chamber portion 11 and the second common liquid chamber portion 12. Such a configuration may not prevent pressure fluctuations from being transmitted to other nozzles, thus causing the fluctuations to be transmitted to and affect other nozzles. By contrast, as illustrated in FIG. 1, the second common liquid chamber portion 12 as the discharge-side common liquid chamber is disposed, thus preventing pressure fluctuations from being transmitted to and affect other nozzles.

As illustrated in FIG. 1, the second common liquid chamber portion 12 is partitioned by the diaphragm 32 from the individual channel 22 communicated with the nozzle 40. Here, by forming a portion of the diaphragm 32 to be a thin film, the damper 35 is formed side by side with a supply port 37 for supplying discharge liquid to the individual channel 22. The damper 35 deforms due to pressure fluctuations of discharge liquid and changes the volume of the second common liquid chamber portion 12, thus preventing pressure fluctuations occurring in a nozzle due to liquid discharge from affecting other nozzles. To allow the deformation of the damper 35, a recess is disposed at a corresponding portion of the channel substrate 34 to form the damper chamber 36. Note that the damper chamber 36 is communicated with an outside air through a communication passage.

Figure 9:
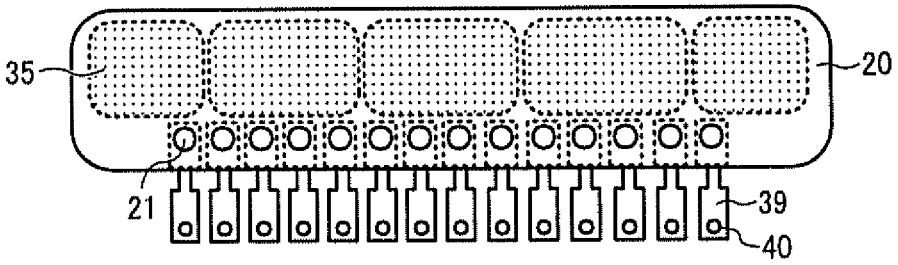
FIG. 9 is an illustration of yet still another example of the partition.

FIG. 9 is a schematic plan view of the above-described configuration. Note that FIG. 9 is an illustration of a positional relationship of the partition 20 and the dampers 35 and it is not that the damper 35 is formed in the partition 20. Therefore, in FIG. 9, the dampers 35 are illustrated by broken lines. In this embodiment, the damper portions are formed across an entire range of the common liquid chamber 110. However, if the damper portions are integrally formed in the nozzle array direction, the thin film portion would be larger, thus reducing the stiffness. Therefore, preferably, the damper portions are divided by partitions.

Next, a description is given of the relationship between the cross-sectional area of the first common liquid chamber portion 11 and the cross-sectional area of the second common liquid chamber portion 12. In the above-described embodiment, in a cross section perpendicular to the nozzle array direction, the cross-sectional area of the first common liquid chamber portion 11 is greater than the cross-sectional area of the second common liquid chamber portion 12.

Here, considering the flow amount difference and the temperature characteristics of viscosity of discharge liquid, preferably, the cross-sectional area of the first common liquid chamber portion 11 is not less than twice as great as the cross-sectional area of the second common liquid chamber portion 12 in the cross section perpendicular to the nozzle array direction.

The viscosity of discharge liquid in the head 404 varies with temperature. The higher the temperature, the lower the viscosity. As the viscosity decreases, the fluid resistance against discharge liquid flowing through a tube decreases in approximately proportion to the viscosity. Of the first common liquid chamber portion 11 and the second common liquid chamber portion 12 partitioned by the partition 20, the temperature of discharge liquid in the second common liquid chamber portion 12 is higher. In the second common liquid chamber portion 12, no flow of discharge liquid is generated by a liquid feeder as disposed in the first common liquid chamber portion 11 and a flow of discharge liquid is generated by only consumption due to liquid discharge. Accordingly, discharge liquid remains longer in the common liquid chamber 110, thus increasing the temperature. The second common liquid chamber portion 12 abuts the individual channel 22 and the pressure chamber (individual liquid chamber) 36 that abut the pressure generator (the piezoelectric element 42) as a heat source.

Accordingly, the temperature of discharge liquid in the second common liquid chamber portion 12 becomes higher and the viscosity of discharge liquid in the second common liquid chamber portion 12 becomes lower. As the viscosity is lower, the fluid resistance is lower. As a result, discharge liquid in the second common liquid chamber portion 12 having a higher temperature is easier to flow under the same pressure difference. Accordingly, preferably, the cross-sectional area of the first common liquid chamber portion 11 is not less than twice as great as the cross-sectional area of the second common liquid chamber portion 12.

For example, if, in the first common liquid chamber portion 11, substantially the same amount of discharge liquid as in the second common liquid chamber portion 12 flows in addition to the consumption of liquid due to liquid discharge, the flow amount of discharge liquid in the second common liquid chamber portion 12 is twice as great as the flow amount of discharge liquid in the second common liquid chamber portion 12. In the case of the same cross-sectional area, assuming that a temperature difference of discharge liquid between the first common liquid chamber portion 11 and the second common liquid chamber portion 12 causes the viscosity of discharge liquid in the first common liquid chamber portion 11 to be approximately twice as great as the viscosity of discharge liquid in the second common liquid chamber portion 12, the fluid resistance of the first common liquid chamber portion 11 is greater.

The fluid resistance against a flow of discharge liquid in a laminar flow state in a tube is inversely proportional to the fourth power of the diameter of the tube and is proportional to the square of the cross-sectional area of the tube. Accordingly, under the above-described condition, preferably, the fluid resistance of the first common liquid chamber portion 11 is not greater than the fluid resistance of the second common liquid chamber portion 12. In other words, the cross-sectional area of the first common liquid chamber portion 11 is not less than twice as great as the cross-sectional area of the second common liquid chamber portion 12. When the fluid resistance of the first common liquid chamber portion 11 is not greater than the fluid resistance of the second common liquid chamber portion 12, the fluid resistance against the movement of liquid, which is discharged from each nozzle, in the nozzle array direction in the first common liquid chamber portion 11 is less than the fluid resistance in the second common liquid chamber portion 12. As illustrated in FIG. 3, movement of discharge liquid is performed in the first common liquid chamber portion 11, thus more reducing the temperature difference of liquid in the nozzle array direction.

Accordingly, considering the flow amount difference and the temperature characteristics of viscosity of discharge liquid, preferably, the cross-sectional area of the first common liquid chamber portion 11 is not less than twice as great as the cross-sectional area of the second common liquid chamber portion 12 in the cross section perpendicular to the nozzle array direction.

Additionally, the cross-sectional area of the first common liquid chamber portion 11 is not greater than five times as great as the cross-sectional area of the second common liquid chamber portion 12 in the cross section perpendicular to the nozzle array direction. Such a configuration obtains more advantage by dividing the common liquid chamber 110 into the first common liquid chamber portion 11 and the second common liquid chamber portion 12 with the partition 20.

Note that the term "liquid discharge head" used herein is a functional component to discharge or jet liquid from nozzles. The liquid discharged is not limited to a particular liquid as long as the liquid has a viscosity or surface tension to be discharged from a head. However, preferably, the viscosity of the liquid is not greater than 30 mPa·s under ordinary temperature and ordinary pressure or by heating or cooling. For example, the discharge liquid is a solution, a suspension, or an emulsion including, for example, a solvent, such as water or an organic solvent, a colorant, such as dye or pigment, a functional material, such as a polymerizable compound, a resin, a surfactant, a biocompatible material, such as DNA, amino acid, protein, or calcium, and an edible material, such as a natural colorant. Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication. Examples of an energy source for generating energy to discharge liquid include a piezoelectric actuator (a laminated piezoelectric element or a thin-film piezoelectric element), a thermal actuator that employs a thermoelectric conversion element, such as a thermal resistor, and an electrostatic actuator including a diaphragm and opposed electrodes.

Liquid discharge device In this disclosure, the term "liquid discharge device" is an integrated unit including the liquid discharge head and other functional parts, or the liquid discharge head and other structures, and denotes an assembly of parts relating to the liquid discharge function. For example, the liquid discharge device may be formed of a combination of a liquid discharge head with at least one of a head tank, a carriage, a supply assembly, a maintenance-and-recovery assembly, and a main-scan moving assembly.

Herein, examples of the integrated unit include a combination in which the liquid discharge head and a functional part(s) are combined fixedly to each other through, e.g., fastening, bonding, or engaging, and a combination in which one of the liquid discharge head and a functional part(s) is movably held by another. In addition, the liquid discharge head can be detachably attached to the functional parts or structures each other.

Figure 10:
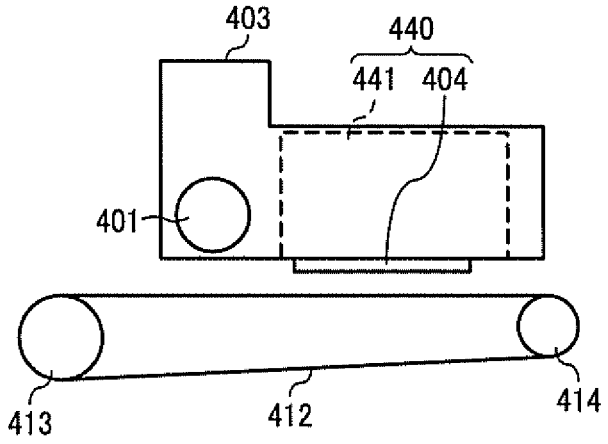
FIG. 10 is an illustration of an example of a liquid discharge head according to an embodiment of this disclosure.

For example, in an example illustrated in FIG. 10, a liquid discharge device 440 includes a liquid discharge head 404 and a head tank 441 integrated together. The liquid discharge head 404 and the head tank 441 may be connected each other via, e.g., a tube to integrally form the liquid discharge device 440. Here, a unit including a filter may further be added to a portion between the head tank and the liquid discharge head, thereby forming another liquid discharge device.

In another example, the liquid discharge device may include a liquid discharge head integrated with a carriage as a single unit.

Figure 11:
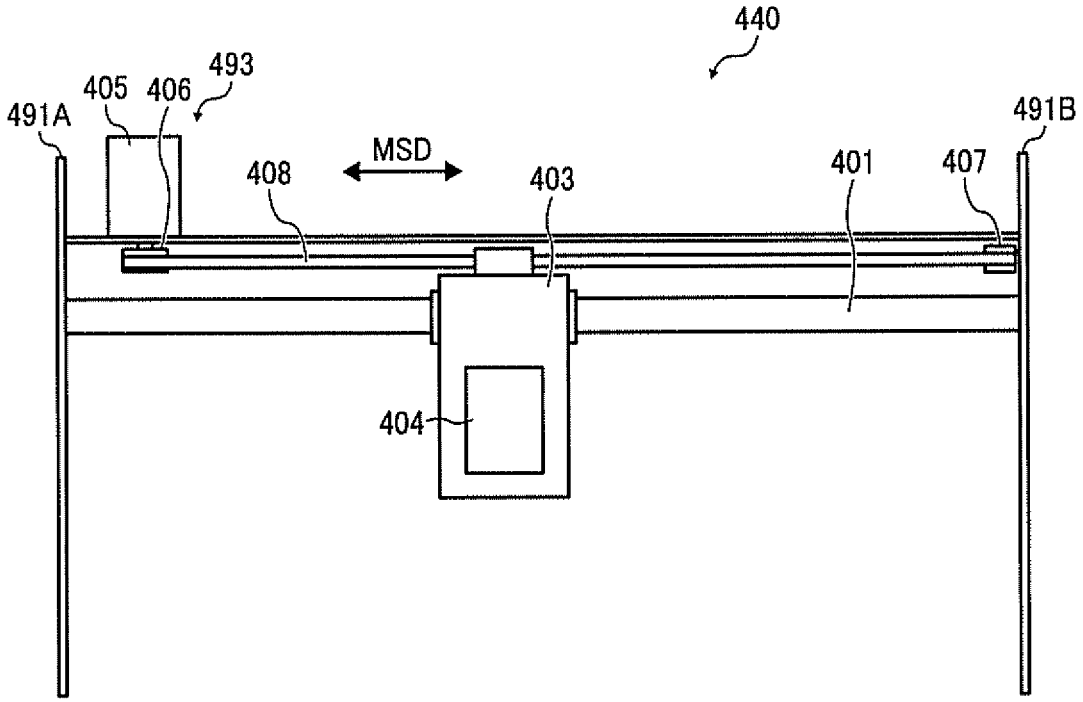
FIG. 11 is an illustration of another example of the liquid discharge head.

In still another example, the liquid discharge device 440 includes the liquid discharge head 404 movably held by a guide 401 that forms part of a main-scan moving assembly 493, so that the liquid discharge head 404 and the main-scan moving assembly 493 are integrated as a single unit. FIG. 11 is an illustration of such an example of the liquid discharge device 440. As illustrated in FIG. 11, the liquid discharge device 440 may include the liquid discharge head 404, the carriage 403, and the main-scan moving assembly 493 that are integrated as a single unit. In FIG. 11, the main-scan moving assembly 493 is configured to reciprocally move the carriage 403 mounting the liquid discharge head 404 in a direction indicated by arrow MSD in FIG. 11.

Furthermore, in another example, a cap member that forms part of the maintenance-and-recovery assembly 117 is secured to the carriage 403 mounted with the liquid discharge head 404 so that the liquid discharge head 404, the carriage 403, and the maintenance-and-recovery assembly 117 are integrated as a single unit to form the liquid discharge device 440.

Figure 12:
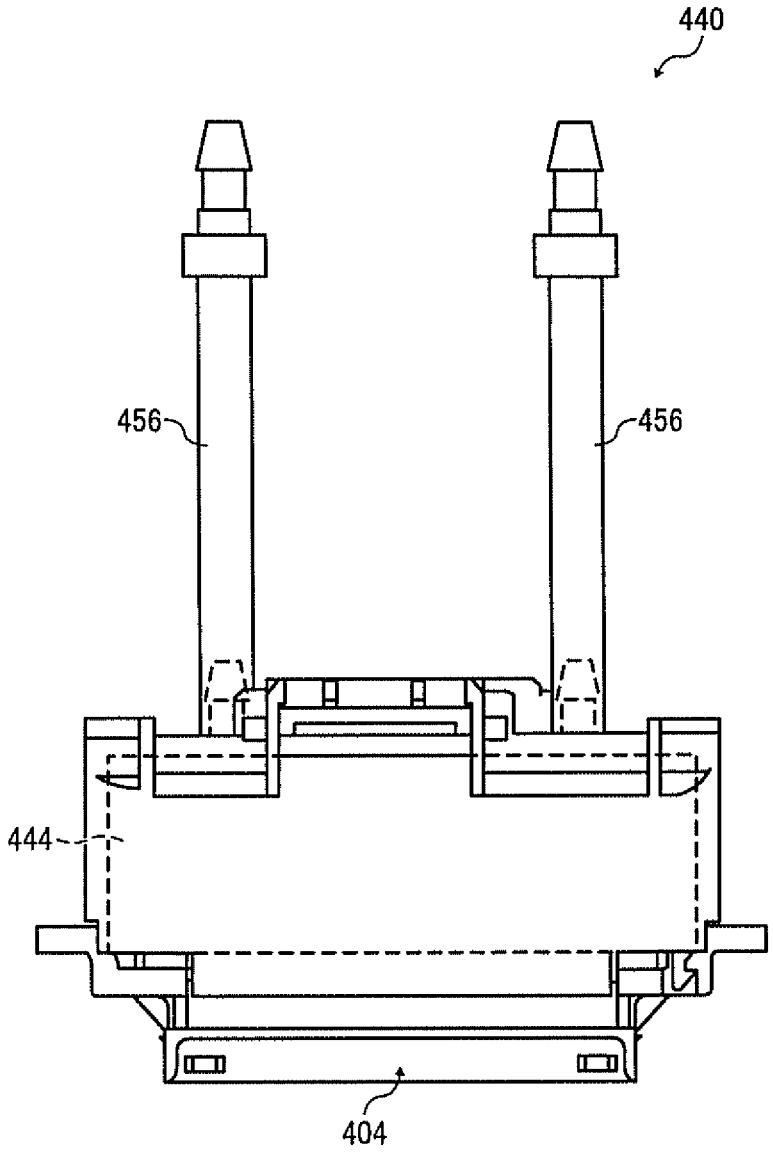
FIG. 12 is an illustration of still another example of the liquid discharge head.

Further, in another example, the liquid discharge device 440 includes tubes 456 connected to the head tank 441 or the channel member 444 mounted on the liquid discharge head 404 so that the liquid discharge head 404 and the supply assembly are integrated as a single unit. FIG. 12 is an illustration of such an example of the liquid discharge device 440. Liquid is supplied from a liquid reservoir source to the liquid discharge head 404.

The main-scan moving assembly 493 may include only a guide, such as the guide 401. The supply assembly may include only a tube(s), such as the tubes 456, or a loading unit.

Liquid discharge apparatus Next, a liquid discharge apparatus according to an embodiment of the present disclosure is described below. In this disclosure, the term "liquid discharge apparatus" represents an apparatus that includes a liquid discharge head or a liquid discharge device and drives the liquid discharge head to discharge liquid. As the liquid discharge apparatus, there are an apparatus capable of discharging liquid to a material on which liquid can be adhered as well as an apparatus to discharge liquid toward gas or liquid.

The liquid discharge apparatus may include devices to feed, convey, and eject the material on which liquid can be adhered. The liquid discharge apparatus may further include a pretreatment apparatus to coat a treatment liquid onto the material, and a posttreatment apparatus to coat a treatment liquid onto the material, onto which the liquid has been discharged.

Examples of the liquid discharge apparatus include an image forming apparatus to form an image on a sheet by discharging ink, and a three-dimensional apparatus to discharge a molding liquid to a powder layer in which powder material is formed in layers, so as to form a three-dimensional article.

In addition, the liquid discharge apparatus is not limited to such an apparatus to form and visualize meaningful images, such as letters or figures, with discharged liquid. For example, the liquid discharge apparatus may be an apparatus to form meaningless images, such as patterns, or fabricate three-dimensional objects.

The above-described term "material on which liquid can be adhered" represents a material on which liquid is at least temporarily adhered, a material on which liquid is adhered and fixed, or a material into which liquid is adhered to permeate. Examples of the "material on which liquid can be adhered" include recording media, such as paper sheet, recording paper, recording sheet of paper, film, and cloth, electronic component, such as electronic substrate and piezoelectric element, and media, such as powder layer, organ model, and testing cell. The "material on which liquid can be adhered" includes any material on which liquid is adhered, unless particularly limited.

Examples of the material on which liquid can be adhered include any materials on which liquid can be adhered even temporarily, such as paper, thread, fiber, fabric, leather, metal, plastic, glass, wood, and ceramic.

The "liquid" is not limited to a particular liquid as long as the liquid has a viscosity or surface tension to be discharged from a head. However, preferably, the viscosity of the liquid is not greater than 30 mPa·s under ordinary temperature and ordinary pressure or by heating or cooling. Examples of the liquid include a solution, a suspension, or an emulsion including, for example, a solvent, such as water or an organic solvent, a colorant, such as dye or pigment, a functional material, such as a polymerizable compound, a resin, a surfactant, a biocompatible material, such as DNA, amino acid, protein, or calcium, and an edible material, such as a natural colorant. Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

The liquid discharge apparatus may be an apparatus to relatively move a liquid discharge head and a material on which liquid can be adhered. However, the liquid discharge apparatus is not limited to such an apparatus. For example, the liquid discharge apparatus may be a serial head apparatus that moves the liquid discharge head or a line head apparatus that does not move the liquid discharge head.

Examples of the liquid discharge apparatus further include a treatment liquid coating apparatus to discharge a treatment liquid to a sheet to coat the treatment liquid on the surface of the sheet to reform the sheet surface and an injection granulation apparatus in which a composition liquid including raw materials dispersed in a solution is injected through nozzles to granulate fine particles of the raw materials.

Figure 13:
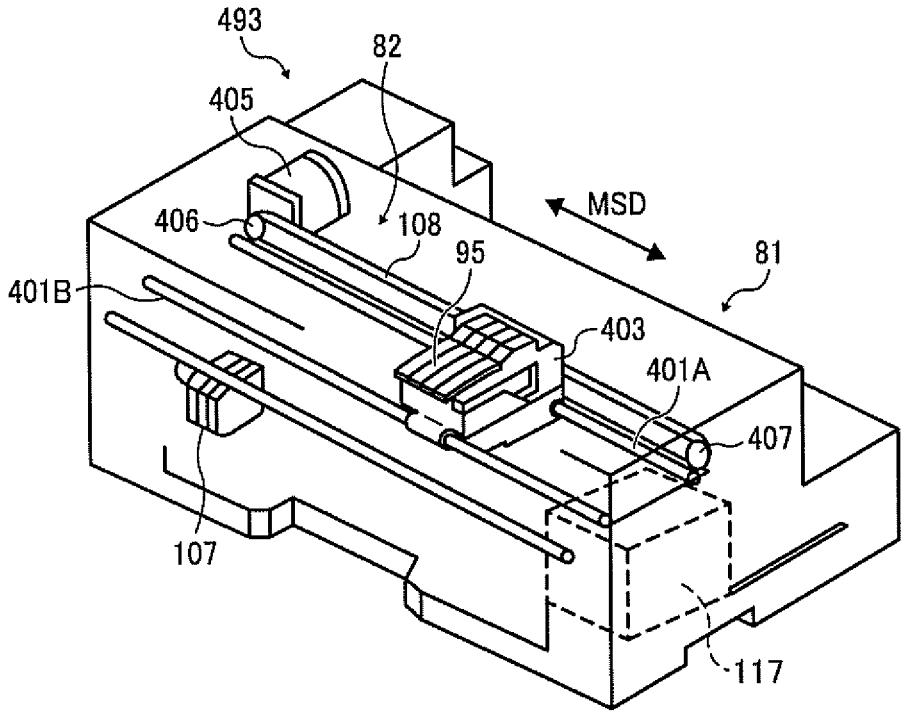
FIG. 13 is a perspective view of a configuration example of an image forming apparatus according to an embodiment of this disclosure.
Figure 14:
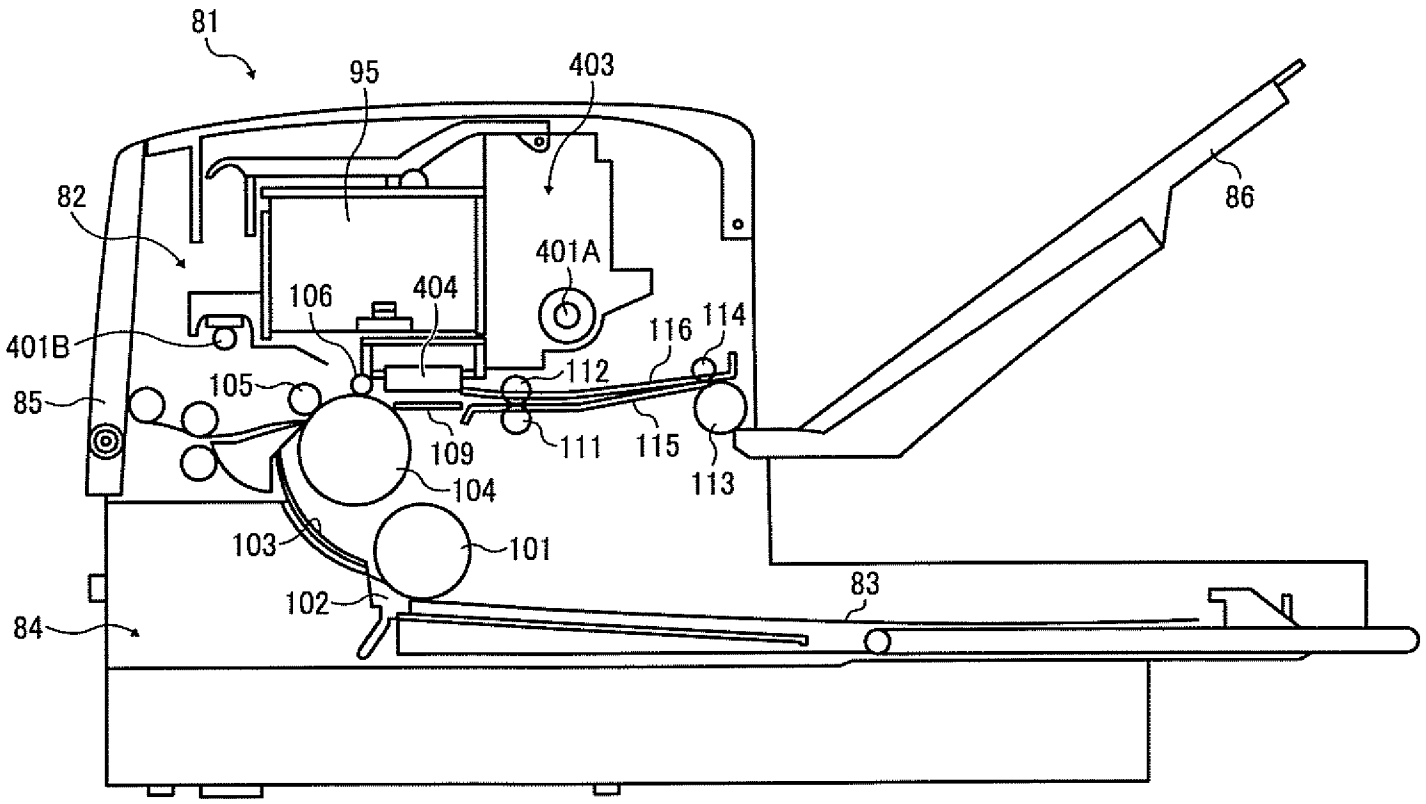
FIG. 14 is a side view of the configuration example of an image forming apparatus of FIG. 14.

Next, an example of the liquid discharge apparatus according to an embodiment of the present disclosure is described with reference to FIGS. 13 and 14. FIG. 13 is a perspective view of the liquid discharge apparatus according to this embodiment. FIG. 14 is a side view of a mechanical section of the liquid discharge apparatus. Note that, in the following descriptions, the liquid discharge apparatus according to this embodiment is described as an image forming apparatus. However, in other embodiments, the liquid discharge apparatus is not limited to the image forming apparatus.

The liquid discharge apparatus according to this embodiment includes, e.g., a printing assembly 82 inside an apparatus body 81. The printing assembly 82 includes, e.g., a carriage 403, the liquid discharge head 404, and ink cartridges 95. The carriage 403 is movable in the main scanning direction MSD. The carriage 403 mounts the liquid discharge head 404. The ink cartridges 95 supply ink to liquid discharge head 404.

A sheet feeding cassette (or a sheet feeding tray) 84 to contain a large amount of sheets 83 is removably mounted from a front side to a lower portion of the apparatus body 81. A bypass tray 85 is tiltable to open to allow a user to manually feed sheets 83. When a sheet 83 fed from the sheet feeding cassette 84 or the bypass tray 85 is taken in, the printing assembly 82 records a desired image on the sheet 83. Then, the sheet 83 is ejected to a sheet ejection tray 86 mounted on a back face side of the apparatus body 81. In the printing assembly 82, a main guide rod 401A and a sub-guide rod 401B as guides laterally bridged between left and right side plates (side plates 491A and 491B in FIG. 11) support the carriage 403 slidably in the main-scanning direction MSD.

The liquid discharge heads 404 according to an embodiment of the present disclosure to discharge ink droplets of different colors of yellow (Y), cyan (C), magenta (M), and black (Bk) are mounted on the carriage 403 so that a plurality of ink discharge ports (nozzles) of is arrayed in a direction crossing the main scanning direction MSD and a discharge direction of ink droplets is oriented downward. The ink cartridges 95 to supply ink of the respective colors to the liquid discharge heads 404 are replaceably mounted on the carriage 403.

Each of the ink cartridges 95 includes an air communication port communicated with the atmosphere in an upper portion of each ink cartridge 95, an ink supply port in a lower portion of each ink cartridge 95, and a porous body to be filled with ink inside each ink cartridge 95. In each ink cartridge 95, ink to be supplied to each liquid discharge head 404 is maintained in slightly negative pressure by capillary force of the porous body. In this embodiment, the liquid discharge heads 404 dedicated for the respective colors are used as the liquid discharge heads. However, in some embodiments, the liquid discharge head may be a single liquid discharge head having nozzles to discharge different colors of ink droplets.

Note that a rear side (a downstream side in a sheet conveyance direction) of the carriage 403 is slidably fitted to the main guide rod 401A, and a front side (an upstream side in the sheet conveyance direction) of the carriage 403 is slidably fitted to the sub-guide rod 401B. The main scanning unit 493 reciprocally moves the carriage 403 for scanning in main scanning direction MSD and includes, e.g., the main guide rod 401A, the sub-guide rod 401B, a main scanning motor 405, and a timing belt 408. The timing belt 408 is stretched taut over a driving pulley 406, which is driven to rotate by the main scanning motor 405, and a driven pulley 407. The timing belt 408 is secured to the carriage 403, and the carriage 403 is driven to reciprocate according to forward and reverse rotation of the main scanning motor 405.

The liquid discharge apparatus 1000 further includes a sheet feeding roller 101 and a friction pad 102 to separate the sheets 83 from the sheet feeding cassette 84 to feed the sheets 83 sheet by sheet to below the heads 404. The liquid discharge apparatus 1000 further includes a sheet guide 103, a conveyance roller 104, a conveyance roller 105, and a leading end roller 106. The sheet guide 103 guides the sheet 83. The conveyance roller 104 conveys the sheet 83 while reversing the sheet 83. The leading end roller 106 regulates a feed angle of the sheet 83 to be fed from between the conveyance roller 104 and the conveyance roller 105 pressed against a circumferential face of the conveyance roller 104. The conveyance roller 104 is driven to rotate by a sub-scanning motor 107 via a gear train.

A print receiver 109 as a sheet guide is disposed below the heads 404 to guide the sheet 83 fed from the conveyance roller 104 in accordance with a movement range of the carriage 403 in the main-scanning direction MSD. On the downstream side of the print receiver 109 in the sheet conveyance direction are disposed a conveyance roller 111 and a spur roller 112 that are driven to rotate so as to feed the sheet 83 in a sheet ejecting direction. The liquid discharge apparatus 1000 further includes a sheet ejection roller 113 and a spur roller 114 to feed the sheet 83 to the sheet ejection tray 86 and guides 115 and 116 constituting a sheet ejection passage.

In recording, the liquid discharge apparatus 1000 drives the liquid discharge heads 404 in response to image signals while moving the carriage 403 to discharge ink to the stopped sheet 83 to record one line of a desired image on the sheet 83. Then, the liquid discharge apparatus 1000 feeds the sheet 83 in a predetermined amount, and then records a next line on the sheet 83. When the liquid discharge apparatus 1000 receives a recording end signal or a signal indicating that a rear end of the sheet 83 has reached a recording area, the liquid discharge apparatus 1000 terminates a recording operation and ejects the sheet 83.

At a position outside a recording area on the right-side end in the direction of movement of the carriage 403, the liquid discharge apparatus 1000 further includes a maintenance-and-recovery assembly 117 to recover discharge failure of the heads 404. The maintenance-and-recovery assembly 117 includes, e.g., a cap unit, a suction unit, and a cleaning unit. The carriage 403 is moved to the side of the maintenance-and-recovery assembly 117 in print standby and the heads 404 are capped with the cap unit. Accordingly, discharge ports (nozzles) are maintained in a wet state, thus preventing discharge failure due to ink drying. In addition, by discharging ink not associated with a recorded image, e.g., during the recording, the viscosity of ink in all the discharge ports is constantly maintained, thus maintaining stable discharging performance.

When discharge failure has occurred, the discharge ports of the heads 404 are tightly sealed with the cap unit, the suction unit sucks, e.g., ink and bubbles from the discharge ports via tubes, and the cleaning unit removes ink and dust adhered to the surfaces of the discharge ports, thus recovering discharge failure. In addition, the sucked ink is drained to a waste ink container disposed on a lower portion of the apparatus body 81, is absorbed into an ink absorber in the waste ink container, and is held in the ink absorber.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge head, comprising:

a plurality of nozzles to discharge liquid;

a plurality of pressure chambers communicated with the plurality of nozzles;

a plurality of pressure generators to generate pressure in the plurality of pressure chambers;

a common liquid chamber to supply liquid to the plurality of pressure chambers, the common liquid chamber including two liquid chamber portions adjacent to each other on a plane parallel to a nozzle array direction in which the plurality of nozzles is arrayed, the two liquid chamber portions including a first common liquid chamber portion to receive liquid from a liquid supply unit and a second common liquid chamber portion to supply liquid to the plurality of pressure chambers;

a partition partitioning the first common liquid chamber portion from the second common liquid chamber portion, the first common liquid chamber portion including at least one liquid inlet at a first end and at least one liquid outlet at a second end opposite the first end in the nozzle array direction; and a liquid feeder to supply liquid to the at least one liquid inlet and to drain liquid from the at least one liquid outlet, wherein the partition includes openings, a first surface bounding the first common liquid chamber portion, and a second surface opposite to the first surface and bounding the second common liquid chamber portion, each of the first surface and the second surface extending in a planar direction parallel to said plane, and each opening amongst the openings of the partition extends from the first surface of the partition to the second surface of the partition, and a representative length of the opening which corresponds to a smallest length of the opening in the planar direction, anywhere in the opening from the first surface of the partition to the second surface of the partition, throughout a flow path of liquid through the partition from the first common liquid chamber to the second common liquid chamber, is greater than a nozzle diameter of each of the plurality of nozzles, the second common liquid chamber portion has a cross-sectional area smaller than a cross-sectional area of the first common liquid chamber portion in a cross section of the two common liquid chamber portions perpendicular to the nozzle array direction.

2. The liquid discharge head according to claim 1, wherein the cross-sectional area of the first common liquid chamber portion is not less than twice as large as the cross-sectional area of the second common liquid chamber portion.

3. The liquid discharge head according to claim 1, wherein the openings of the partition are evenly disposed relative to an array of the plurality of nozzles.

4. The liquid discharge head according to claim 1, wherein the openings are disposed across an entire range of the partition in the nozzle array direction.

5. The liquid discharge head according to claim 1, wherein the second common liquid chamber portion includes a damper portion on a first face opposite a second face facing the partition.

6. The liquid discharge head according to claim 5, wherein the damper portion is divided into a plurality of segments in the nozzle array direction.

7. The liquid discharge head according to claim 1, wherein the partition has a higher thermal conductivity than a thermal conductivity of the liquid.

8. The liquid discharge head according to claim 1, wherein the openings have a circular shape or a slit shape.

9. A liquid discharge device comprising the liquid discharge head according to claim 1.

10. A liquid discharge apparatus comprising the liquid discharge device according to claim 9.

11. A liquid discharge apparatus comprising the liquid discharge head according to claim 1.

12. The liquid discharge head according to claim 1, wherein the openings of the partition are disposed across an extent of the common liquid chamber in the nozzle array direction.

13. The liquid discharge head according to claim 1, wherein at least one of the openings of the partition is circular, and each circular opening of the partition has a diameter greater than the nozzle diameter of each of the plurality of nozzles.

* * * * *